US011156426B2

(12) United States Patent
Chia et al.

(10) Patent No.: US 11,156,426 B2
(45) **Date of Patent: *Oct. 26, 2021**

(54) HINGED TOY LAUNCHER WITH MIRRORED SCOPE

(71) Applicant: Easebon Services Limited, Kwun Tong (HK)

(72) Inventors: Francis See Chong Chia, Kowloon (HK); Steven J. Huebl, Jordan, MN (US)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 17/019,635

(22) Filed: Sep. 14, 2020

(65) Prior Publication Data

US 2021/0003363 A1 Jan. 7, 2021

Related U.S. Application Data

(63) Continuation of application No. 16/589,570, filed on Oct. 1, 2019, now Pat. No. 10,801,800.

(60) Provisional application No. 62/857,069, filed on Jun. 4, 2019.

(51) Int. Cl.

| | |
|---|---|
| ***F41B 4/00*** | (2006.01) |
| ***F41B 11/89*** | (2013.01) |
| ***F41G 1/46*** | (2006.01) |
| *F41B 7/08* | (2006.01) |

(52) U.S. Cl.

CPC ..... *F41B 4/00* (2013.01); *F41G 1/46* (2013.01); *F41B 7/08* (2013.01); *F41B 11/89* (2013.01)

(58) Field of Classification Search

CPC .... F41B 4/00; F41B 7/08; F41B 11/00; F41B 11/64; F41B 11/642; F41B 11/89; F41G 1/40; F41G 1/46; F41C 23/04

USPC ..... 124/1, 78, 83, 87; 42/75.04, 118

See application file for complete search history.

(56) References Cited

U.S. PATENT DOCUMENTS

| | | | | | |
|---|---|---|---|---|---|
| 1,187,218 | A | * | 6/1916 | Wister | F41A 21/08 42/106 |
| 2,955,586 | A | * | 10/1960 | Hamrick | F41A 21/00 124/57 |
| 3,262,440 | A | * | 7/1966 | Kuhn | F41B 11/51 124/67 |
| 3,441,270 | A | * | 4/1969 | Nielsen | A63F 9/0252 446/473 |
| 4,878,305 | A | * | 11/1989 | Gabrielidis | F41A 19/09 42/72 |

(Continued)

*Primary Examiner* — Alexander R Niconovich

(74) *Attorney, Agent, or Firm* — Amster, Rothstein & Ebenstein LLP

(57) ABSTRACT

A toy projectile launcher having a front portion, a rear portion, a hinge connecting the front portion and the rear portion, a handle connected to the front portion and adapted to rotate the front portion against the rear portion around the hinge among a left orientation, a right orientation, and a center orientation, and a rotatable two-way mirror, the handle being rotatable around a same axis of rotation as the hinge, and the rotatable two-way mirror being coupled to the front portion via a mechanical transmission adapted to translate a rotation of the front portion around the hinge to a rotation of the rotatable two-way mirror at a 2:1 ratio.

12 Claims, 13 Drawing Sheets

(56) References Cited

U.S. PATENT DOCUMENTS 5,605,140 A * 2/1997 Griffin ..... F41B 11/642 124/59
5,715,802 A * 2/1998 Moore ..... F41B 11/00 124/66
5,901,693 A * 5/1999 Smith ..... F41B 11/642 124/66
6,276,085 B1 * 8/2001 Wooten ..... F41B 13/00 102/483
6,324,779 B1 * 12/2001 Tippmann, Jr. ..... F41A 21/00 124/81
6,543,173 B1 * 4/2003 Golan ..... F41A 19/09 42/75.04
6,715,227 B2 * 4/2004 Swain ..... F41G 1/41 42/118
6,805,111 B2 * 10/2004 Tippmann, Jr. ..... F41A 21/00 124/74
6,901,691 B1 * 6/2005 Little ..... F41A 23/02 42/118
7,437,847 B1 * 10/2008 Mabry ..... F41C 23/04 42/71.02
7,552,557 B1 * 6/2009 Mabry ..... F41A 11/04 42/71.01
8,336,531 B2 * 12/2012 Fan ..... F41B 11/64 124/65
8,517,004 B2 * 8/2013 Walterscheid ..... F41A 21/20 124/64
8,707,940 B2 * 4/2014 Zheng ..... F41B 11/66 124/64
9,010,002 B2 * 4/2015 Popa-Simil ..... F41G 3/12 42/1.06
9,228,795 B1 * 1/2016 Kielsmeier ..... F41C 23/04
9,395,150 B2 * 7/2016 Park ..... F41G 1/38
9,581,410 B1 * 2/2017 Chang ..... F41B 11/89
9,664,478 B2 * 5/2017 Robinson ..... F41C 23/14
10,156,421 B2 * 12/2018 Smith ..... F41C 23/08
2007/0012720 A1 * 1/2007 Rosenblum ..... G02B 23/08 222/79
2014/0090629 A1 * 4/2014 Pedersen ..... F41B 7/08 124/16

* cited by examiner

HINGED TOY LAUNCHER WITH MIRRORED SCOPE

CROSS-REFERENCE TO RELATED APPLICATIONS

This application is a continuation of and claims the benefit of U.S. patent application Ser. No. 16/589,570, filed Oct. 1, 2019, which claims the benefit of and priority to U.S. Provisional Patent Application No. 62/857,069, filed on Jun. 4, 2019, the entire contents of which are incorporated by reference herein.

FIELD

The present invention generally relates to a toy launcher having a hinged mechanism for sighting and launching around a corner.

BACKGROUND

Toy launchers that discharge soft projectiles, such as toy foam darts or toy foam balls—commonly referred to as toy "guns" or "shooters"— are well known in the art. The toy projectiles are designed to safely impact upon a target without causing injury or damage.

Toy launchers may use one of various different mechanisms for launching the projectiles. One common mechanism for launching toy projectiles from a toy launcher involves the application of compressed air on the projectiles to launch them. The compressed air must be carefully controlled so as to only be in fluid contact with the projectile or projectiles that are intended to be launched at a particular time. Another known mechanism to launch toy projectiles is to feed the toy projectiles to contact one or more rotating flywheels and thereby propel the projectiles forward toward a target.

SUMMARY

The present invention generally relates to a hinged toy launcher, such as a foam dart launcher, ball launcher, water gun, and the like, where a front portion of the launcher can be turned left or right, on a hinge, to allow for shooting—a projectile such as a foam dart, ball, or water, and the like—around a corner without being exposed to return fire.

According to an exemplary embodiment of the present invention, a hinge mechanism is disposed between the front portion and a rear portion and is configured to be pivotable among a left orientation, a right orientation, and a center orientation. In embodiments, the launcher may be placed in any orientation between the left, center, and right orientations.

According to an exemplary embodiment of the invention, a handle, attached to the hinge, is provided to move the front portion proportionally either right or left, with a two-sided mirror associated with a mirrored scope that also rotates, correspondingly.

According to an exemplary embodiment of the present invention, the turning handle includes a locking mechanism to prevent the front or rear portion from swiveling, thereby to prevent injury from finger pinching.

According to an exemplary embodiment of the present invention, the turning handle allows for the two-sided mirror to be lowered to afford a clear sight when aiming straight.

According to an exemplary embodiment of the present invention, a top scope of the toy launcher is provided with a sliding cover to open side holes for reflecting side images in side-shooting orientations, and to block light in a straight-shooting orientation to enhance sighting when aiming straight.

According to an exemplary embodiment of the present invention, a push rod is coupled to a trigger mechanism in order to deliver darts or other projectiles for launching in the straight-shooting and side-shooting orientations, or any orientations therebetween, for example, through a flywheel mechanism.

BRIEF DESCRIPTION OF THE DRAWINGS

Various exemplary embodiments of this invention will be described in detail, with reference to the following figures, wherein.

DETAILED DESCRIPTION

Figure 1A:
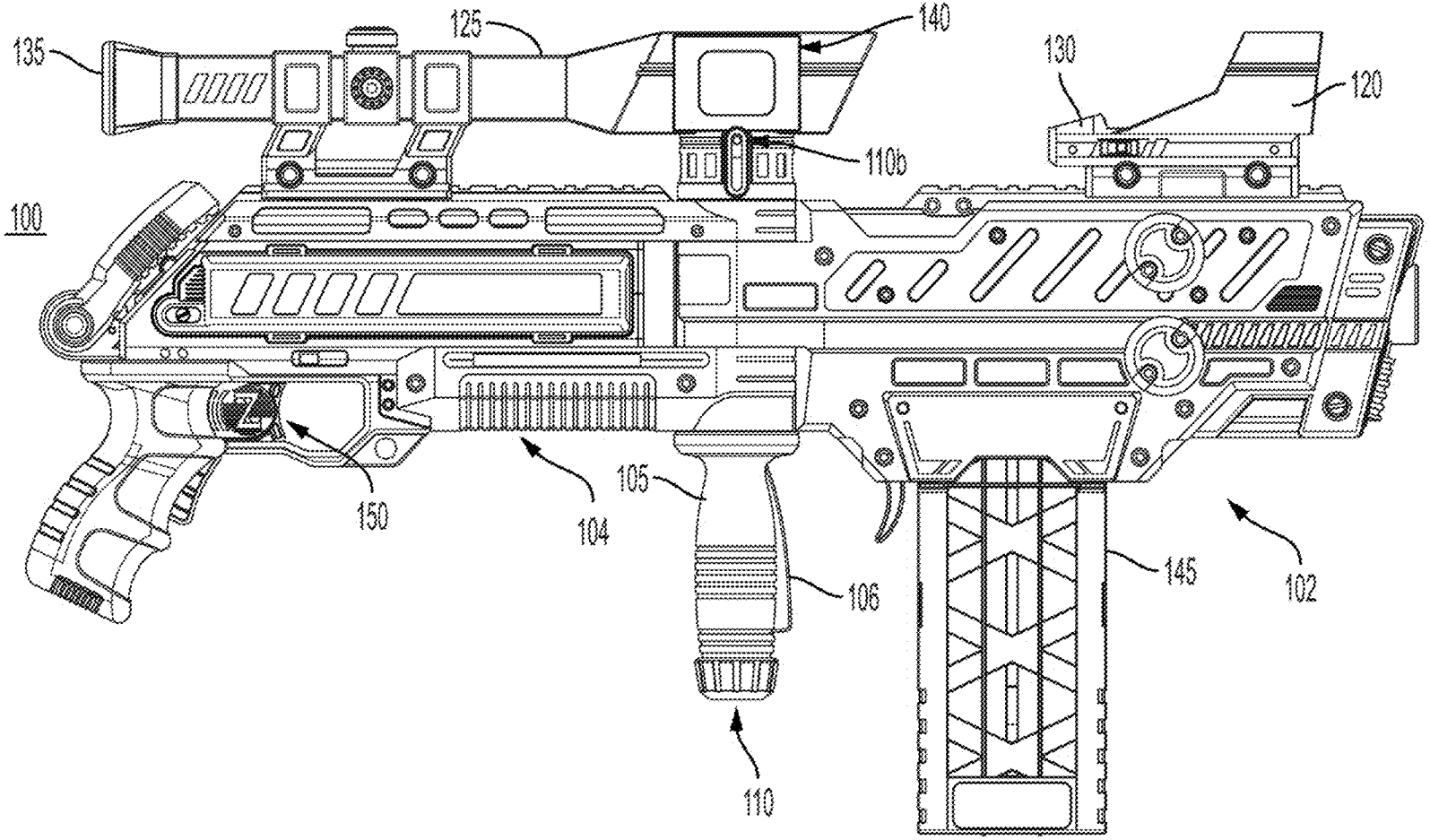
FIG. 1A is a side view of a dart launcher in a straight-shooting orientation according to an exemplary embodiment of the present invention.

The present invention is directed towards a toy launcher, such as a dart launcher, ball launcher, water gun, and the like. The following exemplary embodiment is described based on a toy foam dart launcher, features of which may be incorporated into other types of toy launchers without departing from the spirit and the scope of the invention.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

According to an exemplary embodiment of the present invention, a toy projectile launcher includes a rotatable handle that is coupled to one of a front section of the launcher and a mirror assembly and that is coupled to the other of the front section of the launcher and the mirror assembly via a gear mechanism (e.g., gear train) having a 2:1 or 1:2 gear ratio. In embodiments, the gear mechanism may be replaced by other suitable coupling mechanisms with a 2:1 or 1:2 transmission—such as a friction wheel, belt and pulley, and other similar mechanical means.

Figure 1B:
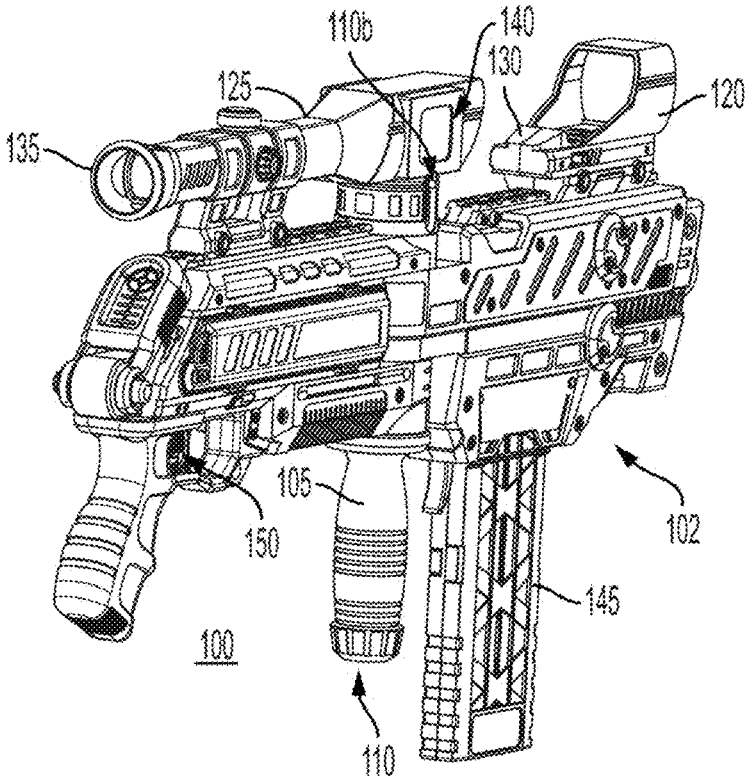
FIGS. 1B and 1C are rear perspective and front perspective views, respectively, of the dart launcher shown in FIG. 1A.
Figure 1C:
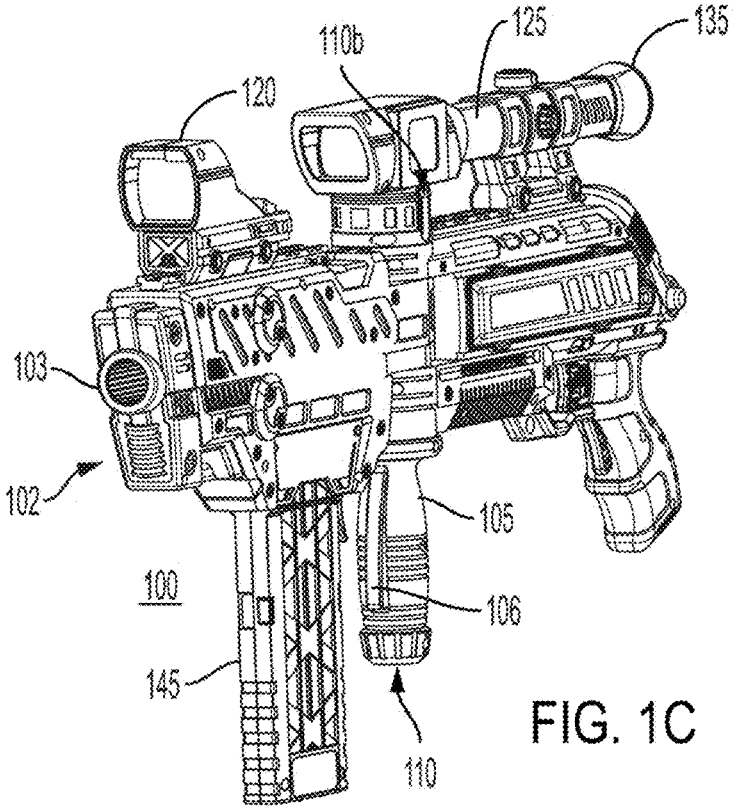

Referring to FIGS. 1A, 1B, and 1C, a dart launcher according to an exemplary embodiment of the present invention is generally described as 100. Dart launcher 100 may be configured to launch one or more darts (as described in further detail below and illustrated in FIGS. 7A-7C) therefrom. In embodiments, the darts may be non-lethal projectiles for use in recreational activities.

Dart launcher 100 includes a housing with a hollow interior to accommodate internal components of the dart launcher 100. The housing of dart launcher 100 may have an elongate configuration, such as that of a rifle stock, to facilitate handling by a user. As shown in FIGS. 1A-1C, dart launcher 100 includes a front section 102 that houses at least a portion of the dart launching mechanism for launching a foam dart through a barrel 103 extending to a front end of dart launcher 100. The front section 102 is connected to a rear portion 104 of dart launcher 100 through a hinged pivot that is coupled to, and controlled by, a rotatable handle 105. As illustrated in FIGS. 1A-1C, rotatable handle 105 is a vertical handle extending downward from a bottom portion of launcher 100 at the hinge connection between front section 102 and rear section 104. In embodiments, rotatable handle 105 includes a release locking mechanism 106 that locks the handle 105 in place when not depressed, so that the hinged pivot between front section 102 and rear portion 104 is locked in place for stability and accuracy of launched foam darts during use. Thus, a user would need to press down on release lock 106 in order to rotate handle 105. Handle 105 may further include a straight-shooting lock mechanism 110 that, when pulled downward away from rotatable handle 105, lowers an internal mirror 325 within a rear sight element 125, as described in further detail below. In embodiments, handle 105 may be a dial, or the like, that is directly or indirectly connected to front section 102.

According to another exemplary embodiment of the present invention and as illustrated in FIGS. 1A-1C, one or more knobs 110*b* on either or both sides of launcher 100 extend outward through a vertical track 112. Knob(s) 110*b* are connected to a base of the internal mirror 325, which base is biased upward with a spring element as described in further detail below. As will also be described in further detail below, a temporary fastening element, such as a catch, latch, and the like, is engaged when knob(s) 110*b* are moved downward to the bottom of the track 112 while launcher 100 is in the straight-shooting orientation. According to an exemplary embodiment of the invention, rear portion 104 may include a hollow interior to accommodate additional internal components that operate with those in the front section 102 for a dart launching mechanism. As an example, a power source—such as a housing for a replaceable and/or rechargeable battery(ies)—may be incorporated in the rear portion 104 for powering the launching mechanism housed within the front section 102.

As further shown in FIGS. 1A-1C, dart launcher 100 includes a pair of sight elements—i.e., a front sight element 120 and a rear sight element 125 disposed on top portions of front section 102 and rear section 104, respectively—that include internal channels that are aligned with one another in a direction that is parallel to that of the foam dart barrel 103 shown in FIG. 1C. In embodiments, the front sight element 120 further includes a lighting element 130, which may incorporate a light emitting diode (LED) and the like, that illuminates a sighting target (e.g., 405 shown in FIGS. 4A, 4C, 5B, 6A, and 6B) within the front sight element 120 when viewed from eyepiece 135 on the rear sight element 125. Front sight element 120 and rear sight element 125 each incorporate a hollow internal channel that respectively incorporates one or more clear lenses that are in alignment in the straight-shooting orientation shown in FIGS. 1A-1C.

FIGS. 1A-1C also illustrate side windows 140 on both sides of the rear sight element 125 at portions above the hinge connection between front section 102 and rear section 104—and, correspondingly, handle 105. When the launcher 100 is oriented for regular straight-shooting, an optional cover element, such as a slidable cover, may be put in position to cover side windows 140. Consequently, external light—and corresponding interference—is prevented from entering the rear sight element 130 such that a clearer view may be obtained through front sight element 120 from eyepiece 135.

In the exemplary embodiment shown, dart launcher 100 comprises a detachable cartridge 145 for holding foam darts (not shown) that are launched through barrel 103. Cartridge 145 is a linear cartridge but, in embodiments, may incorporate a circular cartridge, a linked dart chain, and the like, for feeding multiple foam darts to dart launcher 100. The internal mechanism housed in front section 102, an exemplary embodiment of which will be described in further detail below with reference to FIGS. 7A-7C, may include a flywheel launching mechanism, and the like, whereby a pull on the trigger 150 causes a foam dart from cartridge 145 to be advanced and pushed to flywheels that launch the advanced foam dart out through barrel 103. In embodiments, trigger 150 is attached to a cam (not shown) that is attached to a push rod (not shown) to advance a dart, whereby a pull on trigger 150 causes the cam to push forward an assembly connected to the push rod (e.g., through a wheel in a side-shooting orientation) that, in turn, pushes a foam dart advanced from cartridge 145 between two flywheels that launch the foam dart. In embodiments, instead of a flywheel mechanism, the launching mechanism for foam darts may be based on compressed air, a compressed spring(s), or the like. In embodiments, a flexible spring wire or other suitable mechanisms—e.g., a linkage mechanism or the like—may be connected to trigger 150 to advance a foam dart for launching.

Figure 2B:
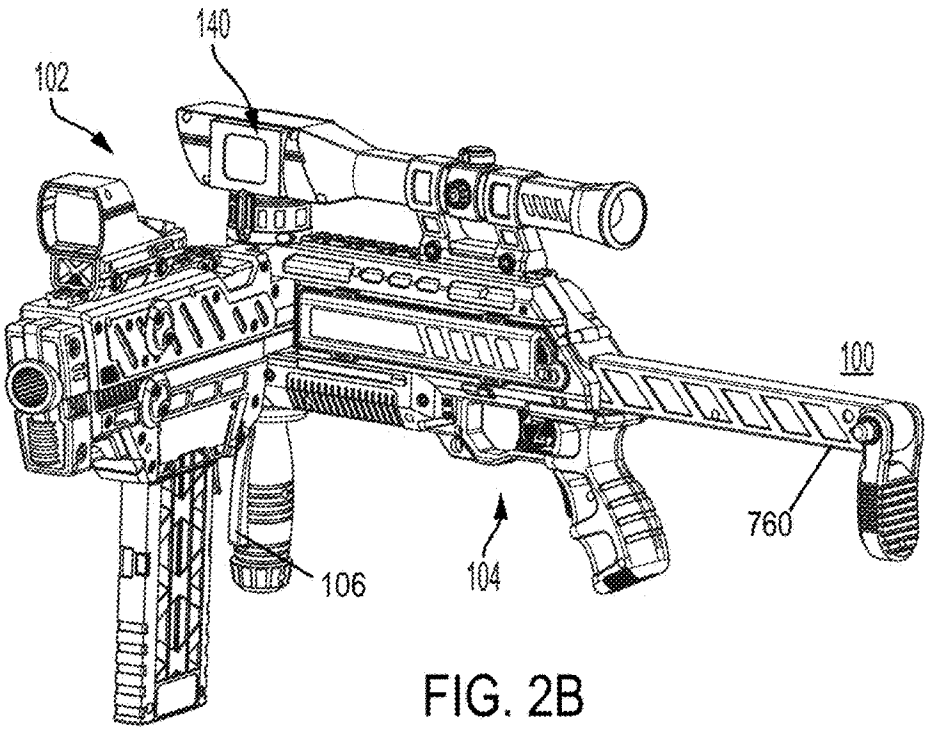
FIGS. 2A and 2B are right front perspective and left rear perspective view, respectively, of the dart launcher shown in FIGS. 1A-1C in a side-shooting orientation.
Figure 2A:
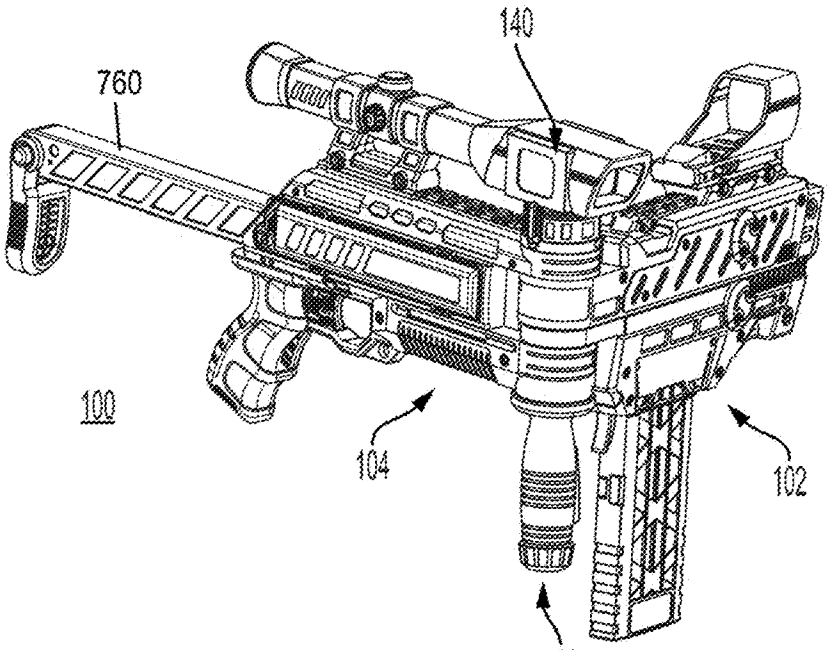

FIGS. 2A and 2B illustrate dart launcher 100 in a (left) side-shooting orientation in accordance with an exemplary embodiment of the invention. With release lock 106 engaged by a user, handle 105 is rotatable such that the user may rotate handle 105 in a counterclockwise (leftward) direction to turn the front section 102—and, as described in further detail below, an internal mirror 325—towards the left hand side—up to and until front section 102 is substantially orthogonal to the rear portion 104 of dart launcher 100 as shown in FIGS. 2A and 2B or rotate handle 105 in a clockwise (rightward) direction to turn the front section 102 (and the mirror 325) to the right hand side. As described above, rear sight element 125 includes side windows 140 that respectively provide for mirrored sighting from eyepiece 135 through front sight element 120, as will be described in further detail below. Thus, in the side-shooting orientation shown in FIGS. 2A and 2B, foam darts may be launched sideways towards the left (or the right in an opposite orientation) with eyepiece 135 providing aim towards the target via an internal mirror and through side windows 140 shown in FIGS. 2A and 2B.

Figure 3:
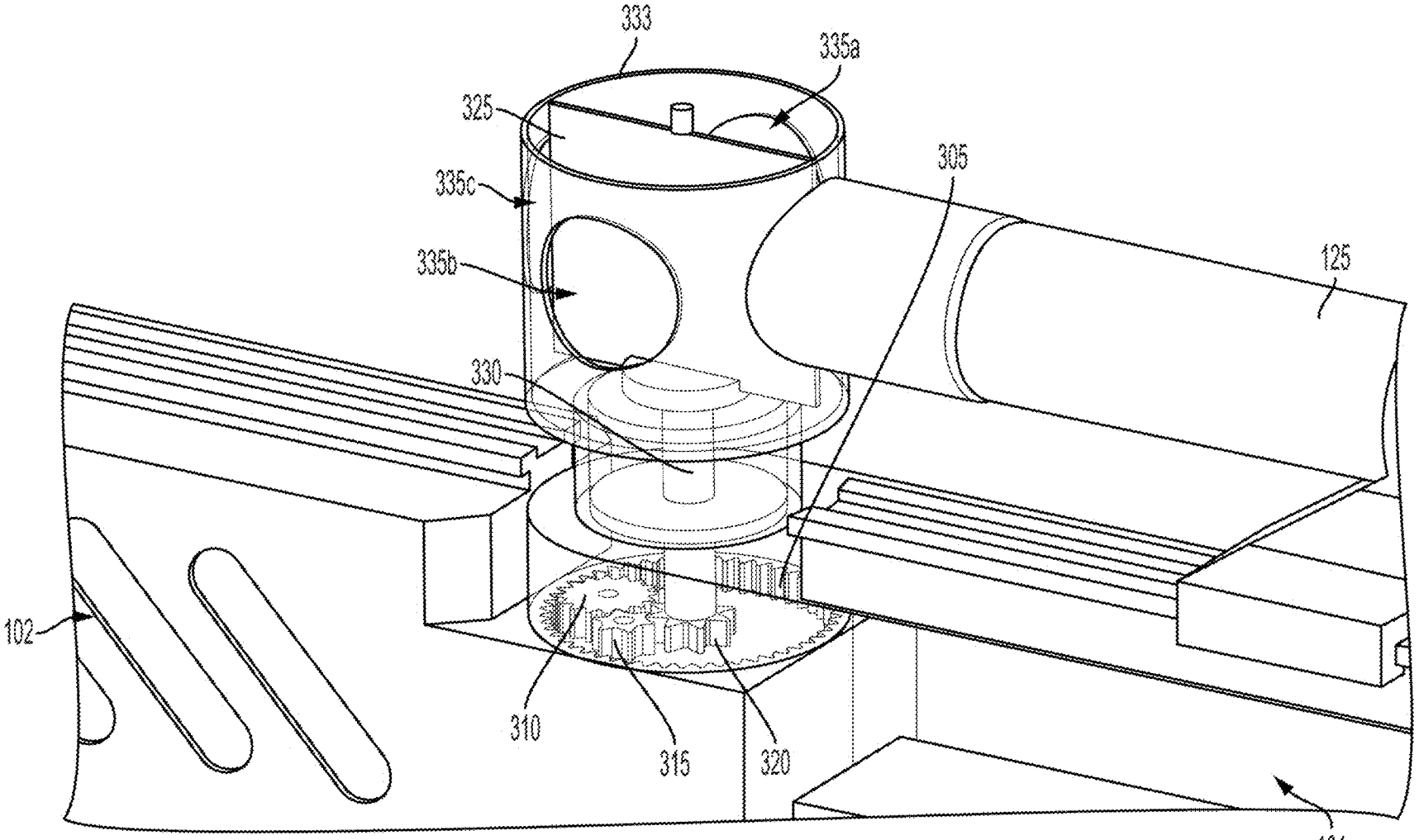
FIG. 3 is an enlarged view, shown partially in cut-away, of an internal mirror mechanism of a rear sight element shown in FIGS. 1A-2B.

FIG. 3 illustrates an exemplary internal mirror mechanism in rear sight element 125 of dart launcher 100 in the straight-shooting orientation of FIGS. 1A-1C. As described above, the front section 102 is coupled to pivot (rotatable) handle 105 and is, thereby, rotatable across approximately 180° between a left side-shooting orientation, as illustrated in FIGS. 2A and 2B, and a corresponding right side-shooting orientation, where front section 102 is substantially orthogonal to the rear portion 104. Referring back to FIG. 3, front section 102 also incorporates a circular internal gear 305, which may be in an annular shape, having gear teeth on an inner peripheral surface thereof. Circular internal gear 305 engages a drive gear 310, which, in turn, engages a directional transfer gear 315. Both drive gear 310 and directional transfer gear 315 are pinned (or anchored) to the rear portion 104 of dart launcher 100. Directional transfer gear 315 further engages a mirror shaft gear 320 that is coupled to a shaft 330 that supports a two-sided mirror 325 within the rear sight element 125. According to an exemplary embodiment of the present invention, mirror shaft 330 extends downward and is directly coupled to mirror shaft gear 320 and as illustrated, for example, in FIGS. 4A, 4C, and 4A, handle 105 is directly coupled to front portion 102 and, correspondingly, circular internal gear 305. Referring back to FIG. 3, directional transfer gear 315 and mirror shaft gear 320 include gear teeth that are spaced farther apart than those of circular internal gear 305 and drive gear 310. According to an exemplary embodiment of the present invention, the gear ratio between drive gear 310 and directional transfer gear 315 is 2-to-1 so that a 90° rotation of the front section 102 and handle 105 is translated to a 45° rotation of mirror shaft 330 and mirror 325. Thus, when handle 105—and, correspondingly, front section 102—is rotated 90° in the counterclockwise direction to the left side-shooting orientation shown in FIGS. 2A and 2B, two-sided mirror 325 is rotated 45° in the same counterclockwise direction so that light incident from front sight element 120 is reflected by 90° towards eyepiece 135. In addition, the internal mirror mechanism according to an exemplary embodiment of the present invention includes an outer (cylindrical) housing 333 around two-sided mirror 325 that incorporates at least four holes, 335*a*, 335*b*, and 335*c* illustrated in FIG. 3 and 335*d* shown in FIG. 4A, that are respective spaced apart by 90° from one another to allow light to pass through from front sight element 120 to eyepiece 135. In contrast from two-sided mirror 325, outer housing 333 is directly coupled to the front section 102 so that a 90° rotation of front section 102 to a side-shooting orientation results directly in a 90° rotation of housing 333 so that a corresponding pair of the four holes from 335*c* (i.e., with 335*a*, 335*b*, or 335*d*) is aligned to allow light to pass through from front sight element 120 to eyepiece 135.

Figure 4B:
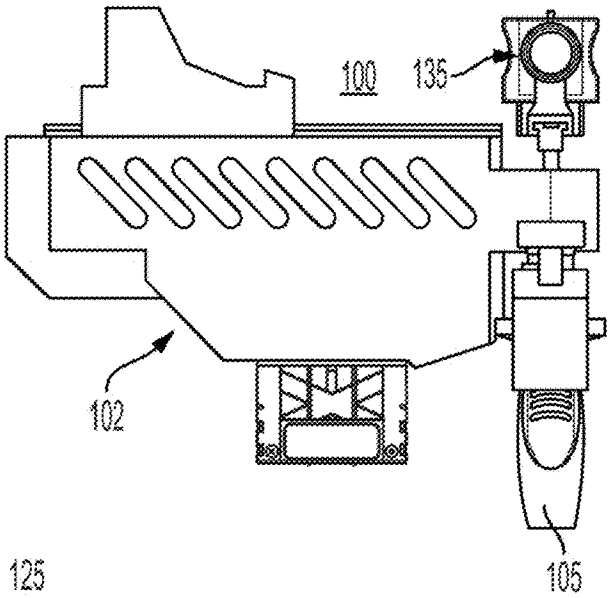
FIG. 4B is a rear partial cut-away view of the dart launcher illustrating a view from an eyepiece through the internal mirror mechanism in the side-shooting orientation according to an exemplary embodiment of the present invention.
Figure 4A:
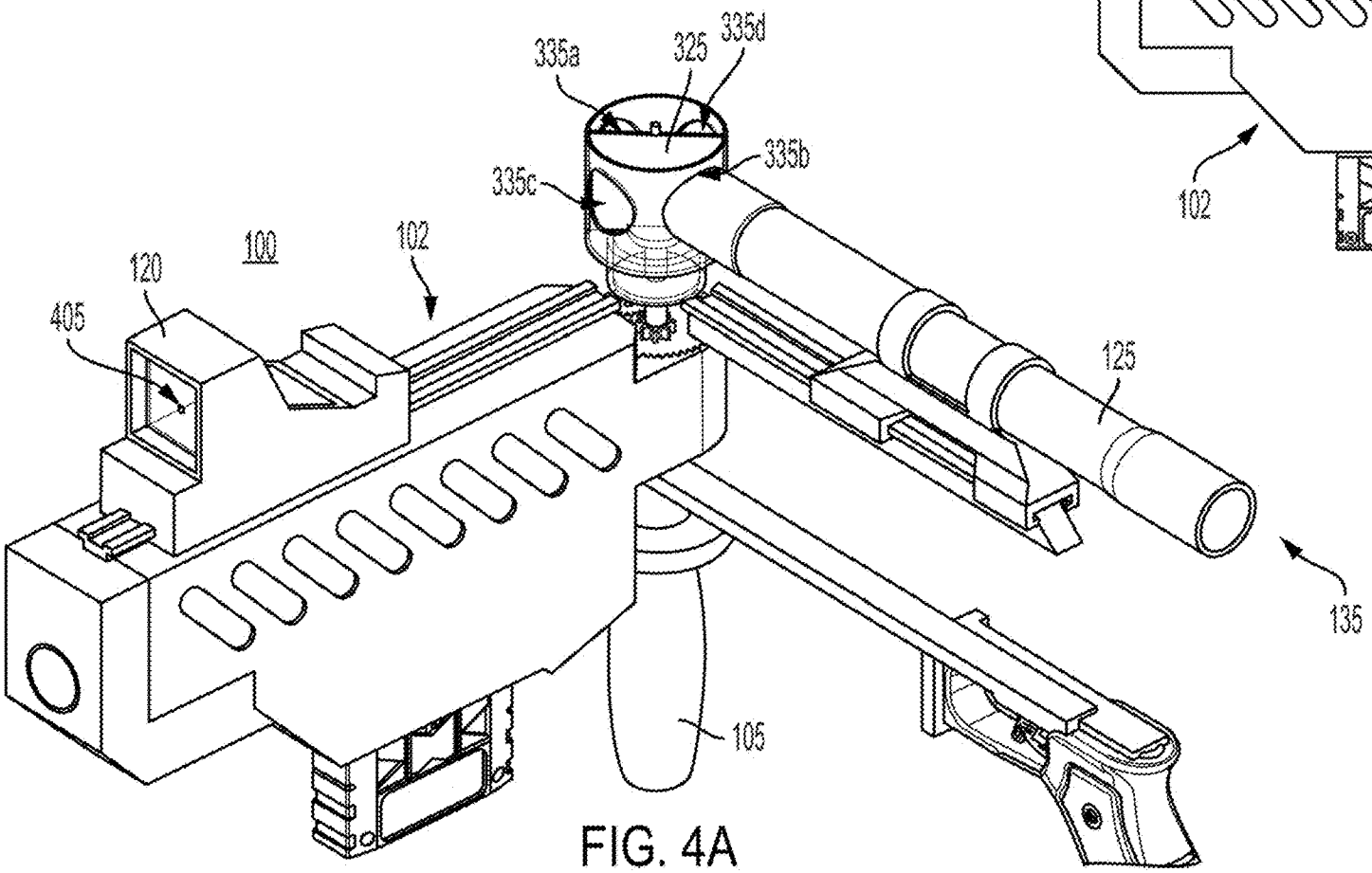
FIG. 4A is a partial cut-away view similar to FIG. 2B, illustrating the internal mirror mechanism shown in FIG. 3 in a side-shooting orientation according to an exemplary embodiment of the present invention.

In other words, in the left side-shooting orientation shown in FIGS. 2A and 2B, handle 105 and housing 333 are rotated 90° in the counterclockwise direction from the front-shooting orientation shown in FIG. 3 and two-sided mirror 325 is rotated 45°, also in the counterclockwise direction, so that hole 335*b* is aligned with the rear sight element 125 and hole 335*c* is aligned with hole 205*b* shown in FIG. 2B. FIG. 4A is a left rear perspective view of dart launcher 100, in partial cutaway, showing these elements in this orientation. As described above, side windows 140 allow light to pass from front sight element 120, reflected by two-sided mirror 325, to eyepiece 135. Thus, as shown in FIG. 4B, a user would be able to view and aim at a target corresponding to the left side-shooting orientation through eyepiece 135. In embodiments, launcher 100 may incorporate mirror 325 without the outer cylinder having holes 335*a-d* illustrated in FIG. 4A such that a reflection of the sight line to front sight element 120 may become visible at eyepiece 135 when front section 102 has been rotated by at least 60° from the straight-shooting orientation—correspondingly, when mirror 325 has been rotated by at least 30°. Accordingly, release lock 106 may be coupled to a friction-based locking mechanism (not shown) that provides for locking front section 102 at any rotated position between 60° and 90°.

Figure 4D:
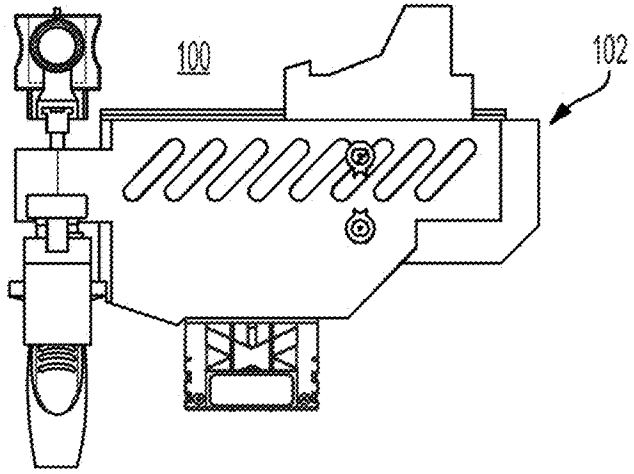
FIG. 4D is a rear partial cut-away view of the dart launcher illustrating a view from an eyepiece through the internal mirror mechanism in the side-shooting orientation of FIG. 4C according to an exemplary embodiment of the present invention.
Figure 4C:
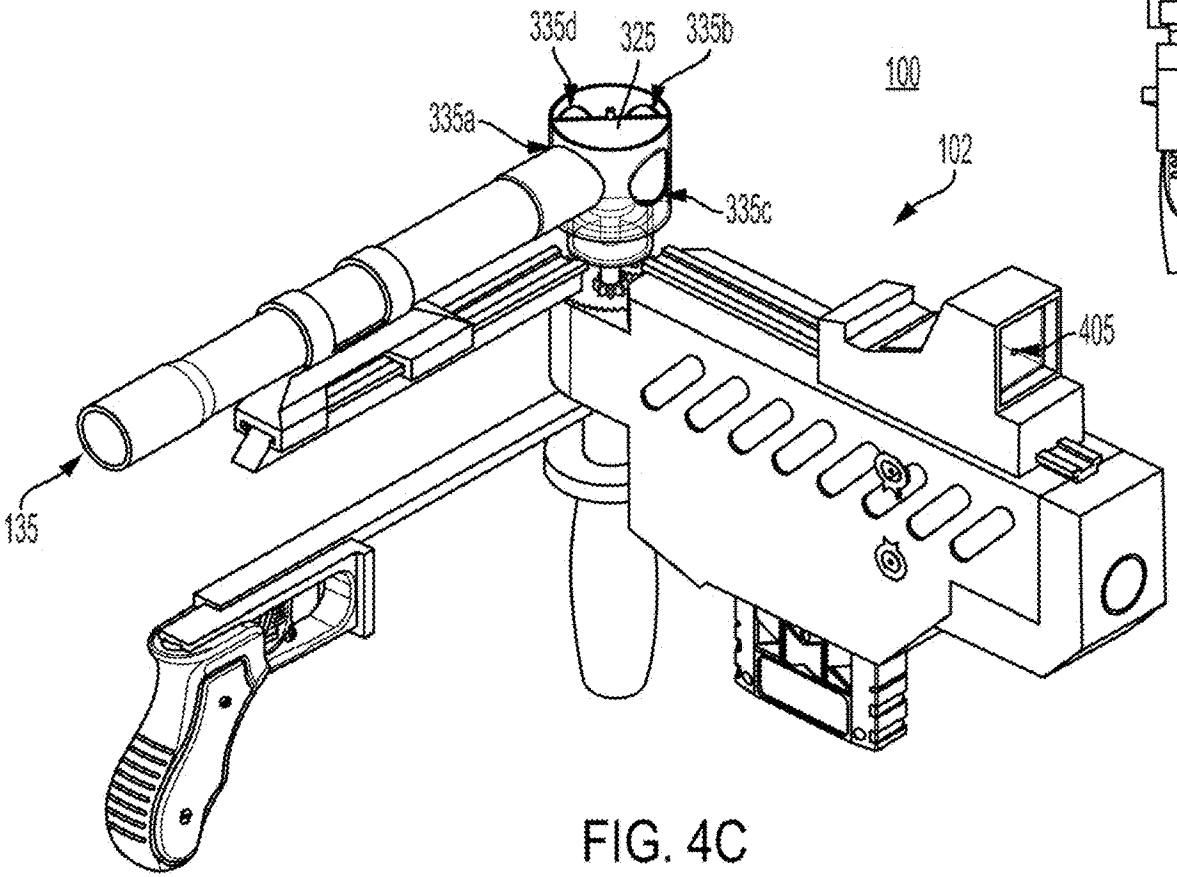
FIG. 4C is a partial cut-away view illustrating the internal mirror mechanism shown in FIG. 3 in another side-shooting orientation according to an exemplary embodiment of the present invention.

FIGS. 4C and 4D illustrate dart launcher 100 in a right side-shooting orientation in correspondence with the views shown in FIGS. 4A and 4B, respectively. As shown therein, the view from eyepiece 135 is reflected by an opposite side of two-sided mirror 325 through holes 335*a* and 335*c* in the right side-shooting orientation. In the right side-shooting orientation shown in FIGS. 4C and 4D, handle 105 and housing 333 are rotated 90° in the clockwise direction from the front-shooting orientation shown in FIG. 3, and two-sided mirror 325 is rotated 45°, also in the clockwise direction, so that hole 335*a* is aligned with the rear sight element 125 and hole 335*c* is aligned with hole 205*a* shown in FIG. 2A. FIG. 4C is a right rear perspective view of dart launcher 100, in partial cutaway, showing these elements in this orientation. As described above, side windows 140, when using dart launcher 100 in this orientation, allow light to pass through from front sight element 120, through two-sided mirror 325 to eyepiece 135. Thus, as shown in FIG. 4D, a user would be able to view and aim at a target corresponding to the right side-shooting orientation through eyepiece 135. Again, in embodiments, launcher 100 may incorporate mirror 325 without the outer cylinder having holes 335*a-d* illustrated in FIG. 4A such that a reflection of the sight line to front sight element 120 may become visible at eyepiece 135 when front section 102 has been rotated by at least 60° from the straight-shooting orientation—correspondingly, when mirror 325 has been rotated by at least 30°. Accordingly, release lock 106 may be coupled to a friction-based locking mechanism (not shown) that provides for locking front section 102 at any rotated position between 60° and 90°.

As shown in FIGS. 4A and 4C, a targeting light 405 may be incorporated in the front sight element 120 for providing an illuminated target, and which simulates a laser targeting mechanism, to the user. According to an exemplary embodiment of the present invention, targeting light 405 is illuminated by lighting element 130 shown in FIGS. 1A and 1B.

Figure 5B:
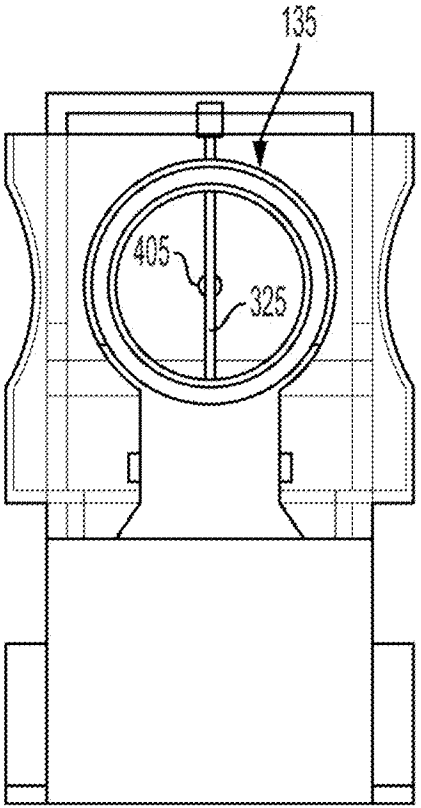
FIG. 5B is an enlarged rear view from the eyepiece of the dart launcher in the straight-shooting, but unlocked, orientation according to an exemplary embodiment of the present invention.
Figure 5A:
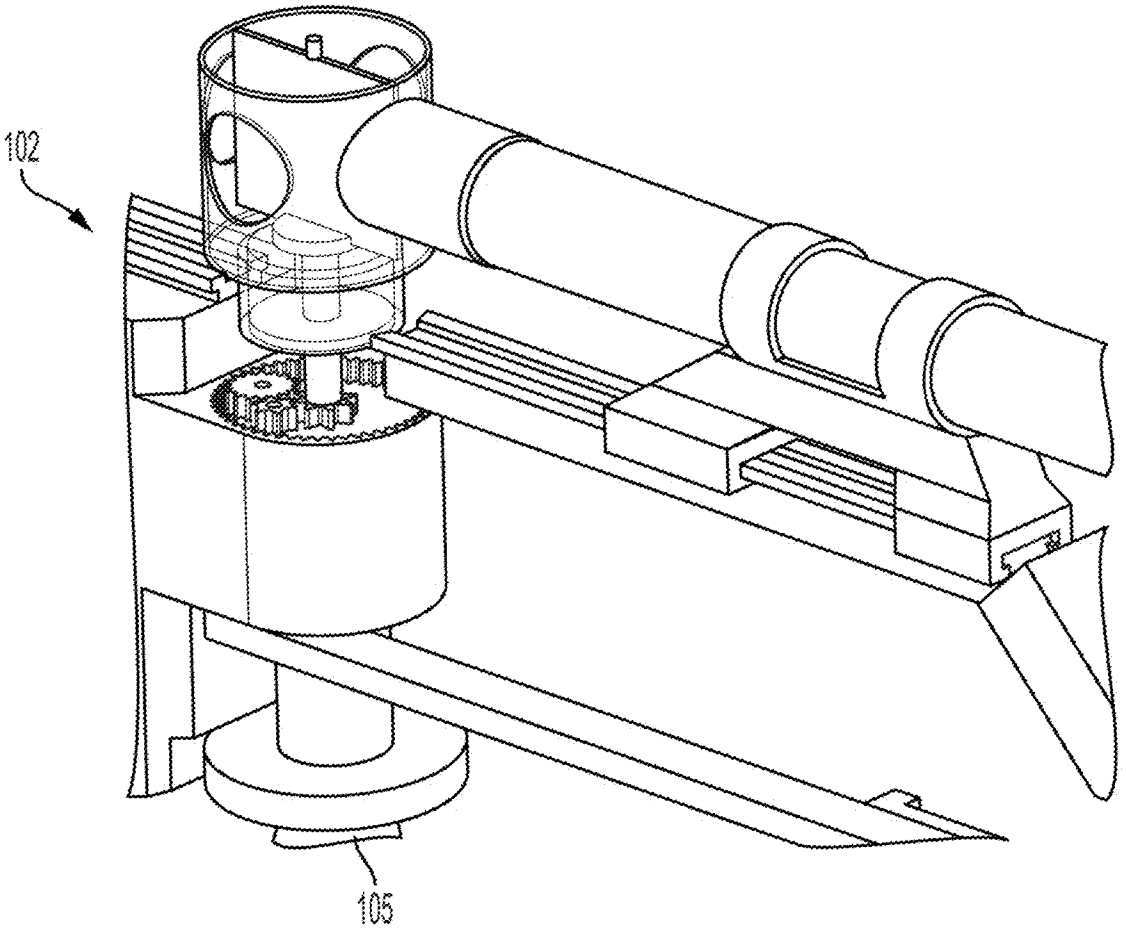
FIG. 5A is a partial cut-away view similar to FIG. 3 illustrating the internal mirror mechanism in a straight-shooting, but unlocked, orientation according to an exemplary embodiment of the present invention.

FIG. 5A is a retracted view of FIG. 3 illustrating the internal mirror mechanism in the straight-shooting orientation and the coupling between front section 102 and handle 105 according to an exemplary embodiment of the present invention. Correspondingly, FIG. 5B is an enlarged rear view from eyepiece 135 in the orientation shown in FIG. 5A. As described above, in the straight-shooting orientation, two-sided mirror 325 is oriented to be parallel with a line of sight from eyepiece 135 so that a view therefrom would only be obstructed by the side profile of two-sided mirror 325. As shown in FIG. 5B, a thin two-sided mirror 325 may provide an acceptable view even of the targeting light 405 in front sight element 120 from eyepiece 135.

Figure 6B:
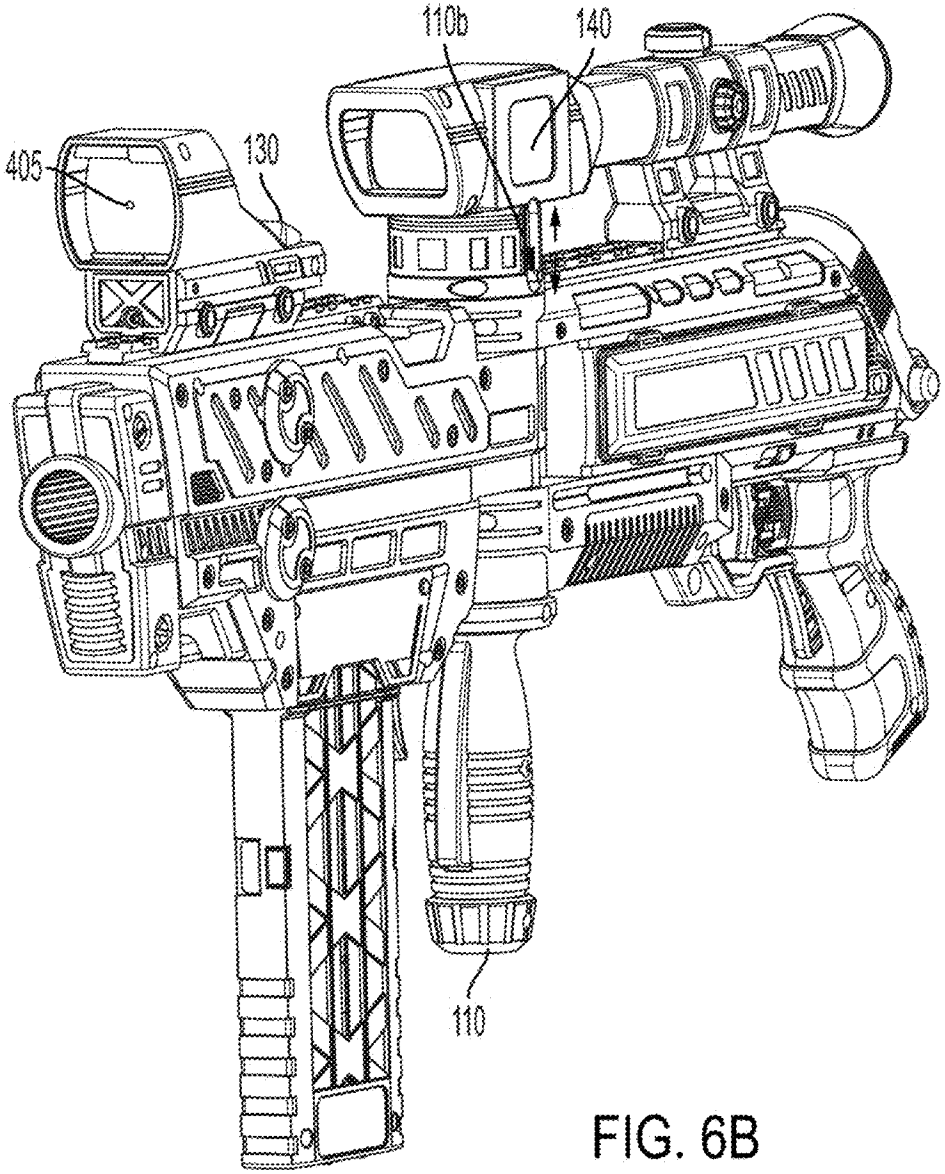
FIGS. 6A and 6B are rear and front perspective views of the dart launcher in a straight-shooting orientation according to an exemplary embodiment of the present invention.
Figure 6A:
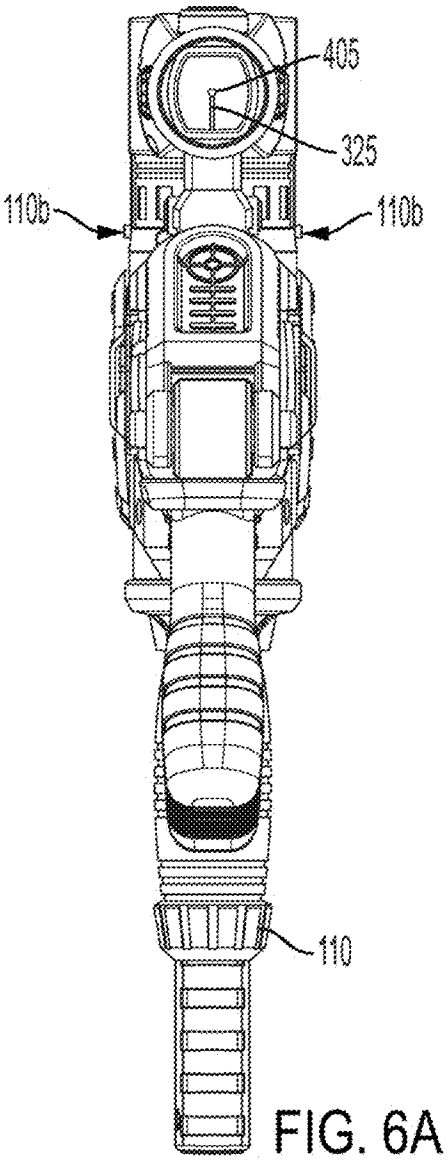

However, to further improve the eyepiece view in the straight-shooting orientation, dart launcher 100 includes one or more knobs 110*b* that lowers two-sided mirror 325, as illustrated in FIGS. 6A and 6B. As shown in FIG. 6A, two-sided mirror 325 is lowered to only obstruct a lower half of the line of sight from eyepiece 135 when knob(s) 110*b* is pulled down. Details of the internal configuration for enabling this mirror lowering will be described in further detail below with reference to FIGS. 8A and 8B. Referring back to FIG. 3, the assembly supporting two-sided mirror 325 may alternatively be coupled to a locking mechanism 110 so that a pull down on locking mechanism 110 is translated to a lowering movement of two-sided mirror 325. In this alternative, front section 102 is locked in place when locking mechanism 110 is pulled down so that it is prevented from swiveling from side to side during straight-shooting operation. In embodiments, the locking mechanism 110 may be usable in the side-shooting orientations, by being detached from the assembly of two-sided mirror 325 so that two-sided mirror 325 is not lowered when the locking mechanism is engaged in such side-shooting orientations. According to another exemplary embodiment of the invention, two-sided mirror 325 may form a U-shape in the straight-shooting orientation—for example, in the view illustrated in FIG. 5B—such that the targeting view is unobstructed in such an orientation. The respective outer surfaces of the U-shape would still serve the side-shooting sight reflection function described above with reference to FIGS. 4A-4D and the U-shape may reduce the need for lowering the mirror 325 in the straight-shooting orientation—thus further simplifying the internal mechanism of launcher 100.

As described above, front section 102 of dart launcher 100 is directly coupled to rotatable handle 105 so that they pivot and rotate—along with mirror shaft 330 via gears 305, 310, 315, and 320—around substantially the same axis on a hinged connection between front section 102 and rear portion 104 according to an exemplary embodiment of the present invention. In embodiments, handle 105 may be coupled to mirror shaft 330, or front section 102, through a gear mechanism, a pulley mechanism, and the like, so that they rotate (or pivot) around respective axes that are parallel with, or offset from (e.g., through a bevel gear), one another. Alternatively, handle 105 may be coupled to mirror shaft 330 (and two-sided mirror 325), and front section 102 may be rotated correspondingly by a gear drive or other suitable mechanism.

Figure 7A:
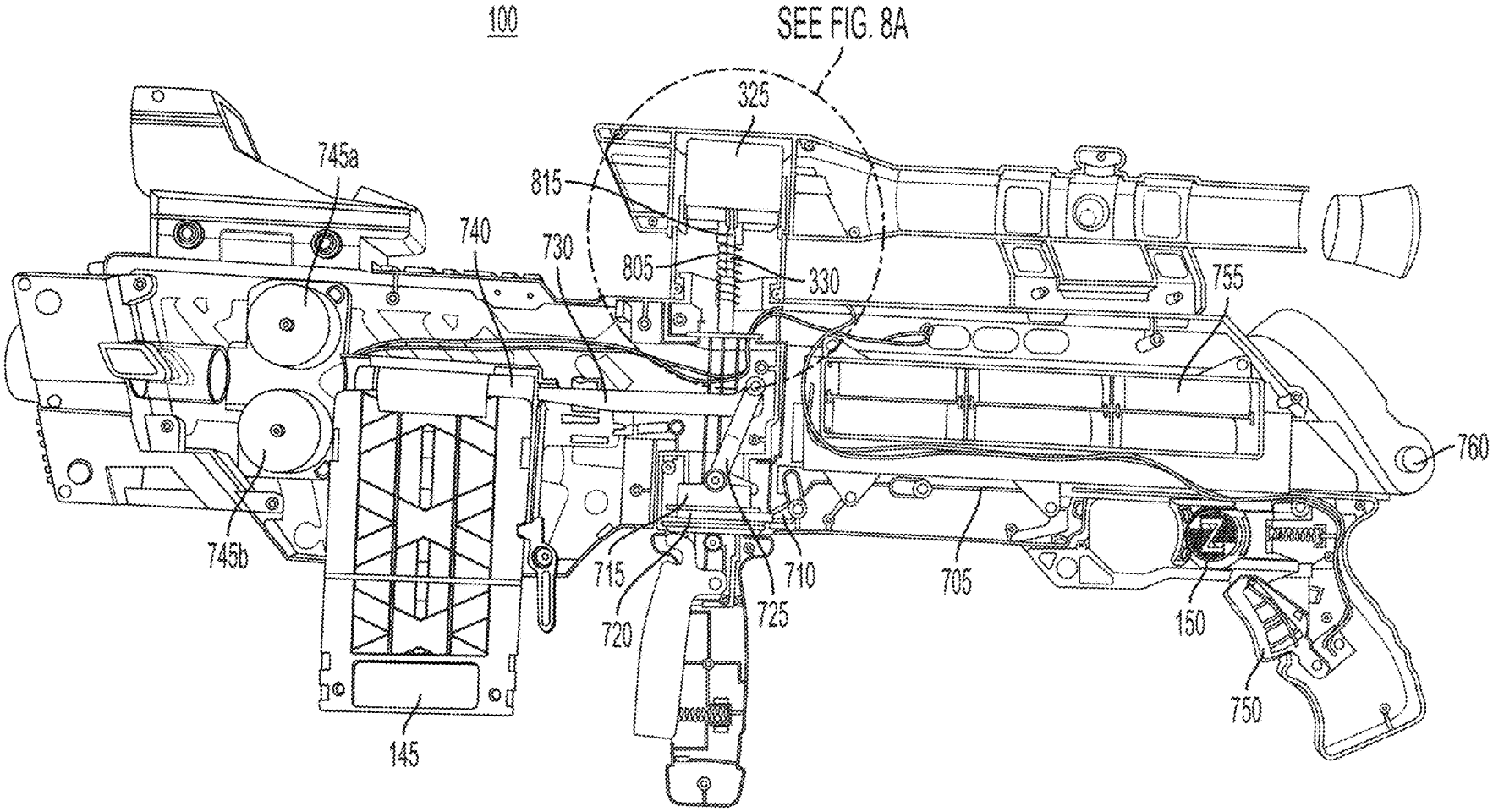
FIGS. 7A, 7B, and 7C are partial cut-away views of dart launcher illustrating operations of the trigger mechanism that is usable in all straight-shooting and side-shooting orientations in accordance with an exemplary embodiment of the present invention.
Figure 7B:
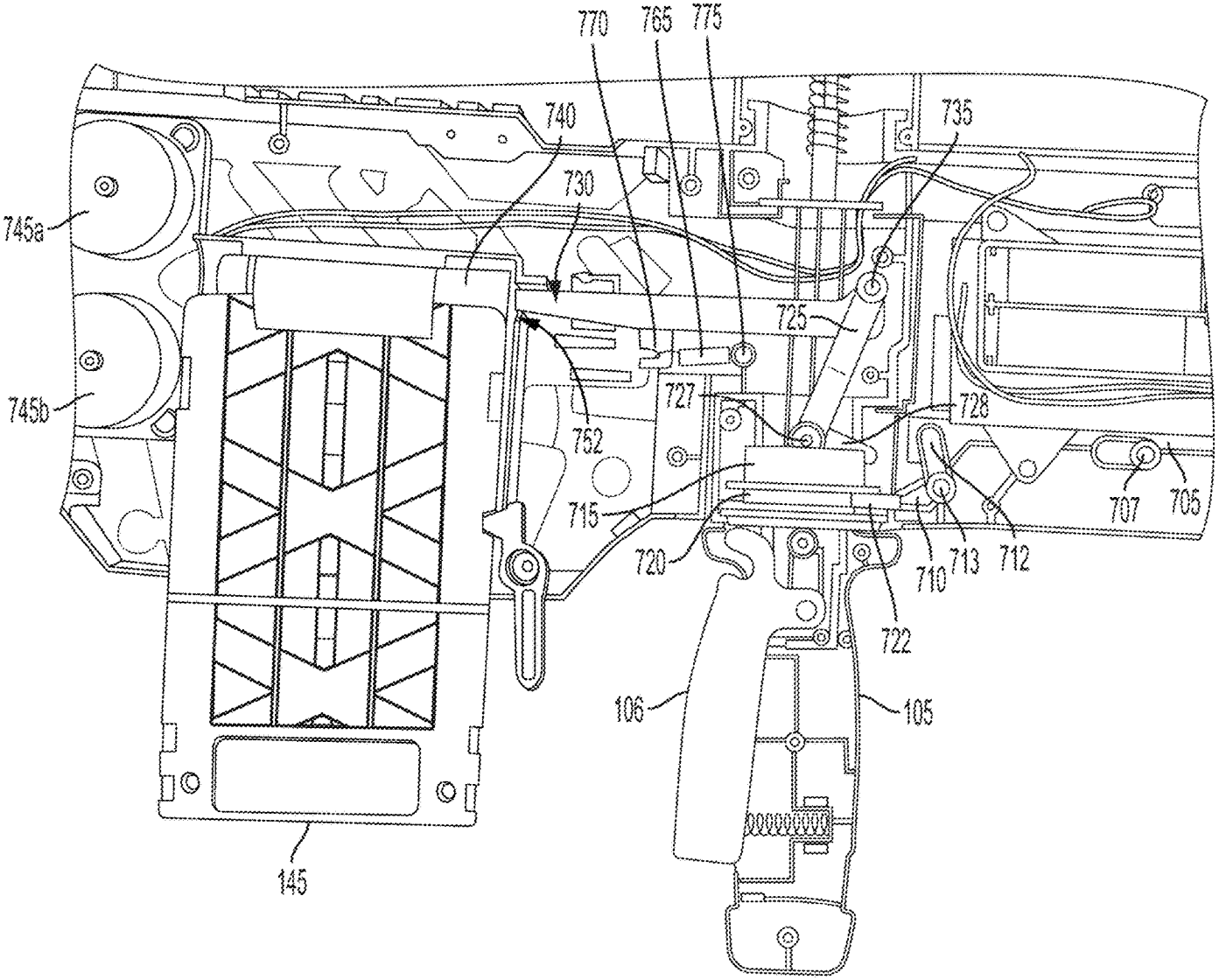
Figure 7C:
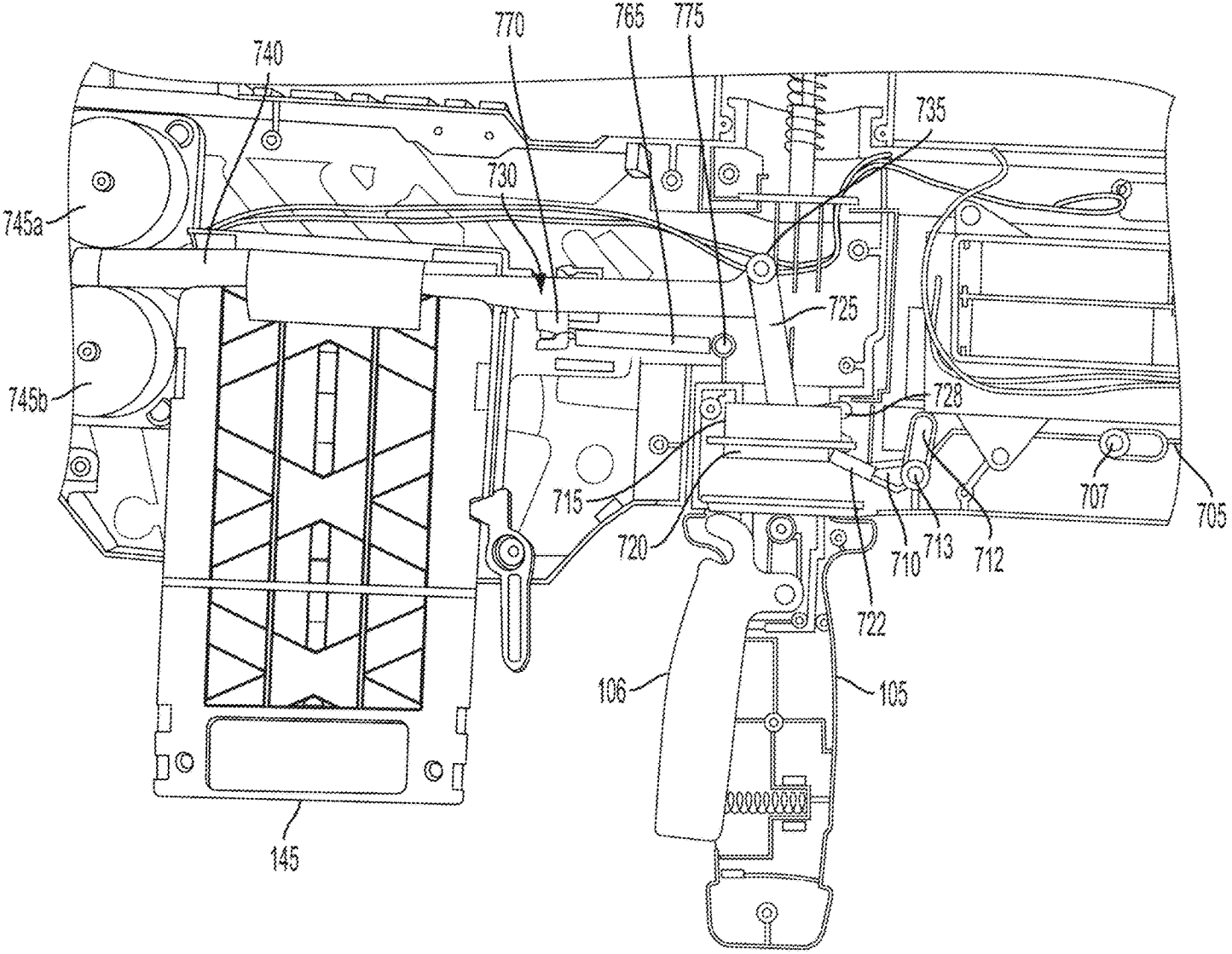

FIGS. 7A, 7B, and 7C are partial cut-away views of dart launcher 100 illustrating operations of a trigger translation mechanism that is usable in all straight-shooting and side-shooting orientations for translating a trigger pull at rear portion 104 to a projectile launch at front portion 102 in accordance with an exemplary embodiment of the present invention.

As described before, launcher 100 includes a trigger 150 for launching a projectile (e.g., toy dart 740) and, as shown in FIG. 7A, trigger 150 is connected to a bar 705 that is, in turn, connected to a pivotable lifting mechanism 710. Lifting mechanism 710 is coupled to a cylindrical lift 715 at a ring structure 720. Cylindrical lift (or hereinafter "cylinder") 715 is coupled to an L-shaped coupler 725 to a push rod 730, which is adapted to push a next toy dart 740 contained in cartridge 145 forward to a position between flywheels 745*a* and 745*b*, which rotated to launch the toy dart 740. In accordance with an exemplary embodiment of the invention, launcher 100 includes a power toggle 750 that electrically couples a power source 755 to the flywheels 745*a* and 745*b*. As shown FIG. 7A, power toggle 750 may be a push lever. Alternatively, a power switch may be used to turn flywheels 745*a* and 745*b* on and off. Power source 755 includes a housing for accommodating replaceable batteries or it may include replaceable or integrated rechargeable batteries. As shown in FIG. 7A, launcher 100 may also include an extendible stock element 760. FIG. 7A shows the stock element 760 in a retracted configuration and FIGS. 2A and 2B illustrate stock element 760 in an extended configuration.

FIGS. 7B and 7C provide sectional cutaway views corresponding to FIG. 7A with closeups on the push rod mechanism for launching a toy dart according to an exemplary embodiment of the invention. FIG. 7B illustrates the dart launching mechanism in a rest state and FIG. 7C shows the dart launching mechanism in a triggered stated. As shown in FIG. 7B, bar 705, which is connected to trigger 150, encloses around an anchoring element 707, which maybe a bolt, screw, or the like. The front end of bar 705 is coupled to an L-shaped pivotable lifting mechanism 710 that includes a bar coupling part 712 and a pivot part 713. The lifting mechanism 710 further includes lifting coupler 722 that fits partially around ring structure 720 of cylindrical lift 715. Ring structure 720 extends from a main cylindrical body of lift 715. According to an exemplary embodiment of the present invention, lift 715 has a hollow cylindrical shape having sufficient thickness and is made from a resilient material (such as a polymer) with sufficient mechanical strength to lift L-shaped coupler 725 at an extension portion 728. Ring portion 720 also includes a lip 720*b* around the circumference of lift 715 such that it overhangs coupler 722 of lifting mechanism, thus allowing coupler 722 to push upward against lip 720*b* to lift cylinder 715. According to an exemplary embodiment of the invention, a small predetermined clearance (not shown) is provided between coupler 722 and ring portion 720 so that cylinder 715 may be rotated along with front portion 102 of launcher 100 by rotating handle 105. In other words, the coupling relationship among coupler 722, ring portion 720, lip 720*b* and cylinder 715 remains the same regardless of whether front portion 104 of launcher is in the straight-shooting (as shown in FIGS. 1A-1C) or side-shooting orientation (as shown in FIGS. 2A-2B), or any position in between.

As shown in FIG. 7B, a top rim of cylinder 715 contacts extension portion 728 of L-shaped coupler 725, which is rotatable around a pivot 727. L-shaped coupler 725 is, in turn, connected to push rod 730 at a rotatable joint 735. As further illustrated FIG. 7B, push rod 730 extends into an opening 752 even at rest so that it is aligned for pushing forward to launch dart 740. Push rod 730—and, correspondingly, the above-described triggering mechanism coupled to push rod 730—is biased backward by spring 765 that is connected between a hook 770 on pushing rod 730 and an anchor 775 disposed in the housing of launcher 100. In other words, pushing rod 730 is pulled backward by spring 765 to return to the rest state shown in FIG. 7B when trigger 150 is released.

Referring now to FIG. 7C, when trigger 150 is pulled backward, again, bar 705 is pulled backward. Anchoring element 707 aligns bar 705 during trigger movement such that a trigger pull provides for bar 705 to be pulled back along an elongate opening 705*b* around anchoring element 707, as illustrated in FIG. 7C. Accordingly, bar coupling part 712 is pulled back by bar 705 and lifting mechanism 710 is pulled upward around pivot part 713. Coupler 722 connected to lifting mechanism 710 is moved upward and pushes up against lip 720*b* of ring portion 720, thereby lifting cylinder 715. The top rim of cylinder 715, thus, pushes extension portion 728 upward and L-shaped coupler 725 is moved forward around pivot 727. Consequently, push rod 730 is moved forward by coupler 725 at joint 735 through opening 752 and pushes dart 740 forward for launching between flywheels 745*a* and 745*b* and out through barrel 103 shown in FIG. 1C. According to an exemplary embodiment of the invention, coupler 725 is forked at joint 735 so that it is rotatably coupled to push rod 730 on both left and right sides (front and back as viewed in FIGS. 7B and 7C) of push rod 730. Together with the fitted dimensions of opening 752, push rod 730 is pushed forward by coupler 725 and pulled backward by spring 765 along trajectories that are substantially parallel to the firing direction of darts 740. According to an exemplary embodiment of the invention, a bottom internal portion of cartridge 145 includes a biasing element (not shown) for pushing up a next dart 740 after a dart 740 has been launched, until cartridge 145 has been emptied.

Figure 8A:
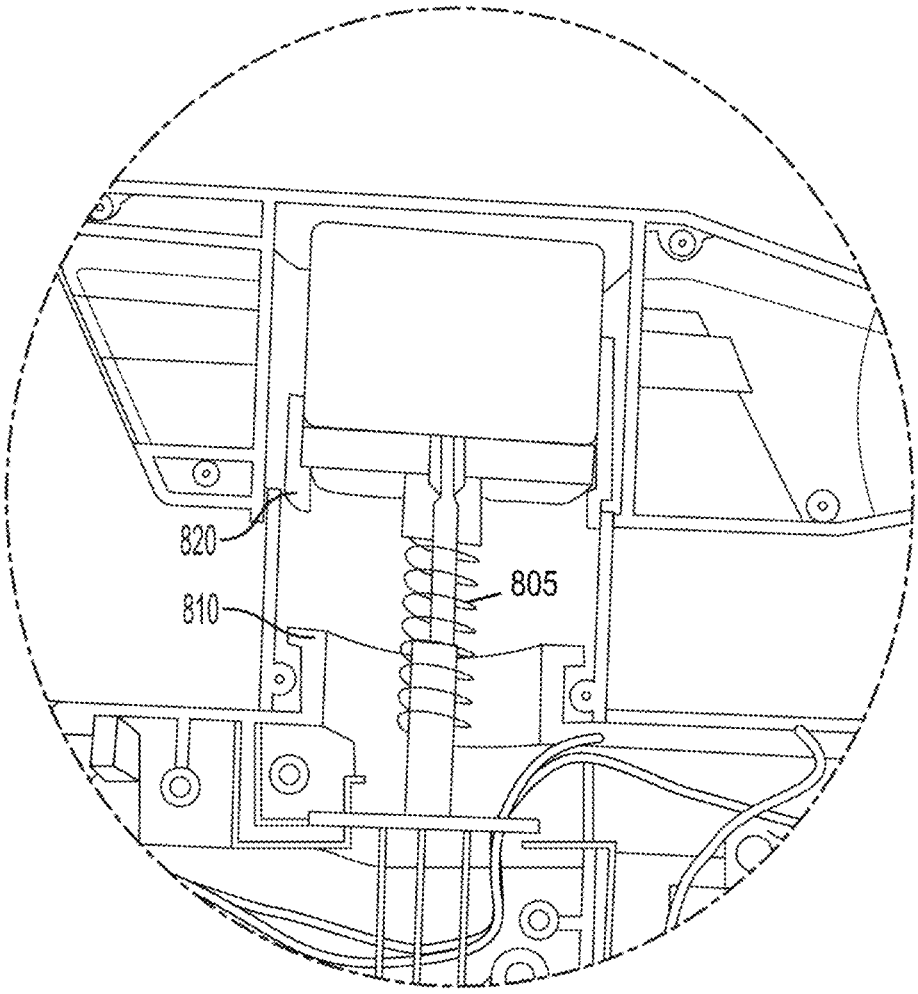
FIG. 8A is an enlarged, partial section view of a portion of FIG. 7A illustrating an internal mirror of the dart launcher according to an exemplary embodiment of the invention.
Figure 8B:
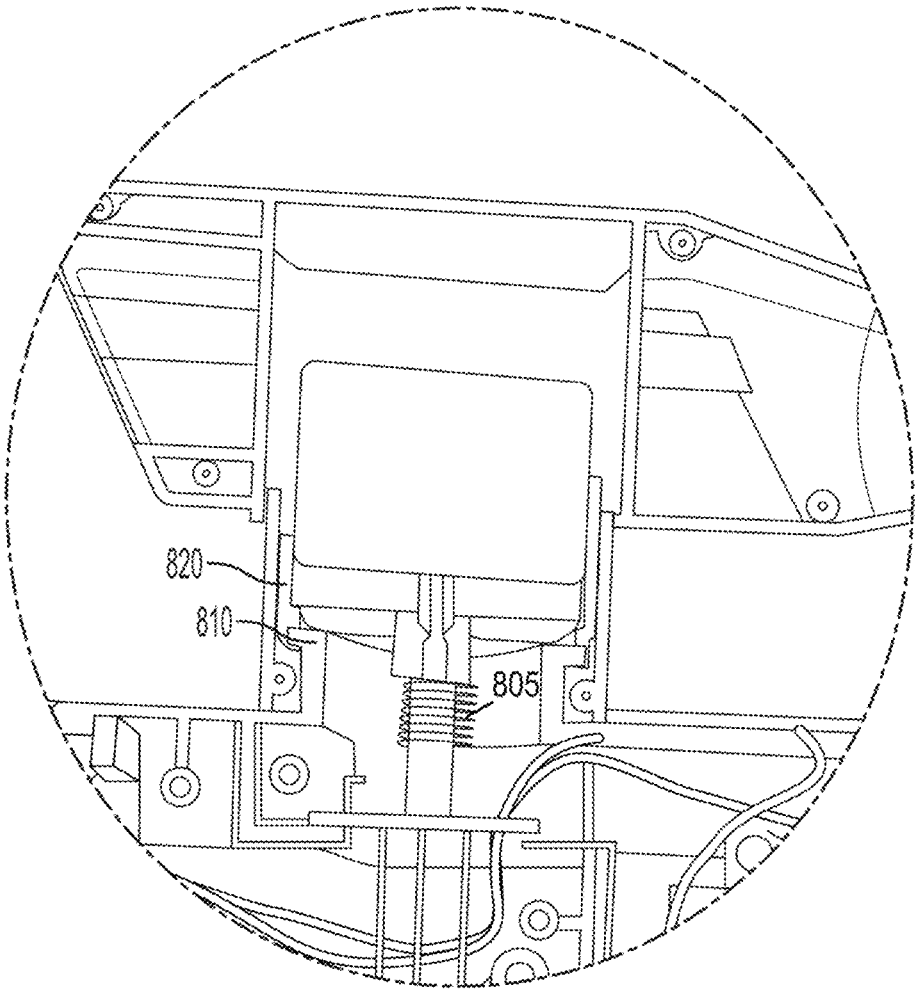
FIG. 8B is a cutaway view corresponding to FIG. 8A showing the internal mirror in a lowered position in accordance with an exemplary embodiment of the present invention.

Next, with reference to FIGS. 8A and 8B, an exemplary embodiment of a mechanism for selectively holding down internal mirror 325 will now be described. As shown in FIG. 8A, in a regular configuration, internal mirror 325 is in an extended position in line with the line of sight provided via elements 120, 125, 135, and 140, as shown in FIGS. 1A-5B. A spring 805 is extended to push the internal mirror 325 upward to the extended position shown in FIG. 8A. Corresponding to the arrangement shown in FIGS. 6A and 6B, FIG. 8B illustrates spring 805 being in a compressed state by having a user move knob 110*b* (FIGS. 6A and 6B) downward until notch 810 engages hook 820. According to an exemplary embodiment of the invention, notch 810 and/or hook 820 may include a resilient portion that provides for a slide-in engagement through the downward force applied by the user on knob 110*b*. Once notch 810 and hook 820 are engaged, mirror 325 is held in the lowered position corresponding to the illustration in FIG. 6A. FIG. 8A illustrates the notch 810 and hook 820 being arranged at a front portion of interior mirror 325 toward a direction of front portion 102 of launcher 100. In embodiments, notch and hook or other types of temporary engagement elements may be disposed at either or both sides of mirror 325—for example, corresponding to the positions of knob(s) 110*b* shown in FIGS. 1A-1C and 6A-6B. According to an exemplary embodiment of the invention, notch 810 and hook 820 are disposed at aligned one or more locations around mirror 325—for example, at an aligned front location shown in FIGS. 8A and 8B—when launcher 100 is in the straight-shooting orientation shown in FIGS. 1A-1C. Notch 810 may be disposed on a base portion that is fixed to rear portion 104 of launcher 100 so that hook 820 is rotated out of alignment with notch 810 when handle 105 is rotated to place launcher 100 in one of the side-shooting orientations—for example, as shown in FIGS. 2A-2B. With notch 810 and hook 820 out of alignment, spring 805 returns mirror 325 to the upward position shown in FIG. 8A. Thus, the notch and hook mechanism illustrated in FIGS. 8A-8B and described above provides for lowering mirror 325 in a straight-shooting orientation of launcher 100, as shown in FIG. 6A, while providing for automatically returning mirror 325 to its reflective position, as illustrated in FIGS. 4A and 4C when handle 105 is rotated to place launcher 100 in one of the side-shooting orientations. Consequently, internal mirror 325 may be held in a lowered position when using launcher in the straight-shooting orientation, thus reducing obstruction in the targeting view through eyepiece 135 and front sight element 120. The temporary fastening element becomes misaligned, and disengaged, when front section 102 is rotated and the spring element returns the internal mirror 325 upward for reflecting the sight line through front sight element 120 to eyepiece 135 when launcher 100 is in a side-shooting orientation.

Although the preferred embodiment is described by reference to a dart launcher, it is to be understood that the hinged toy launcher and mirrored scope mechanism can be adapted for use as a ball launcher, water gun, or other projectile launching means.

While particular embodiments of the present invention have been shown and described in detail, it would be obvious to those skilled in the art that various modifications and improvements thereon may be made without departing from the spirit and scope of the invention. It is therefore intended to cover in the appended claims all such modifications and improvements that are within the scope of this invention.

The invention claimed is:

1. A toy projectile launcher, comprising:

a front portion adapted to launch a projectile;

a rear portion having a trigger;

a hinge connecting the front portion and the rear portion;

a handle connected to the front portion, the handle being adapted to rotate the front portion against the rear portion around the hinge between a left orientation, a center orientation, and a right orientation; and a trigger translation mechanism between the trigger and the front portion adapted to translate a trigger pull to a projectile launch, wherein the trigger translation mechanism comprises a cylinder having an outer circumference and an axis that is parallel to an axis of rotation of the hinge.

2. The toy projectile launcher of claim 1, wherein the handle and the outer circumference of the cylinder are rotatable around a same axis of rotation as the hinge.

3. The toy projectile launcher of claim 2, wherein the trigger translation mechanism further comprises a coupler that is coupled to the trigger.

4. The toy projectile launcher of claim 3, wherein the trigger pull moves the coupler to move the outer circumference of the cylinder in a direction that is parallel to the axis of rotation.

5. The toy projectile launcher of claim 4, further comprising a lip around at least a portion of the outer circumference of the cylinder, wherein the coupler exerts a force on the lip to move the outer circumference of the cylinder in a direction that is parallel to the axis of rotation.

6. The toy projectile launcher of claim 4, wherein the cylinder is coupled to a launch mechanism in the front portion adapted for the projectile launch.

7. The toy projectile of claim 6, wherein the launch mechanism comprises a push rod coupled to the outer circumference of the cylinder, the push rod being adapted to move a projectile for launch when the outer circumference of the cylinder is moved by the coupler.

8. The toy projectile launcher of claim 1, wherein the handle is a vertical handle extending from a bottom portion of the toy projectile launcher along the axis of rotation.

9. The toy projectile launcher of claim 1, wherein the projectile is one of a foam dart, a ball, and water.

10. The toy projectile launcher of claim 1, further comprising a rotatable two-way mirror disposed above the front portion proximate the hinge, wherein the rotatable two-way mirror is coupled to the front portion via a mechanical transmission adapted to translate a rotation of the front portion around the hinge to a rotation of the rotatable two-way mirror at a 2:1 ratio, and wherein the rotatable two-way mirror is rotated via the mechanical transmission around a same axis of rotation as the hinge.

11. The toy projectile launcher of claim 9, wherein the front portion further comprises a front sight element, the rear portion further comprises a rear sight element, and the rotatable two-way mirror is rotated to reflect between the front sight element and the rear sight element in one of the left orientation and the right orientation.

12. The toy projectile launcher of claim 9, wherein the mechanical transmission is selected from the group consisting of a gear train, belt and pulley, and friction wheel.

* * * * *